United States Patent [19]

Tambini

[11] 4,211,120

[45] Jul. 8, 1980

[54] TIGHTENING APPARATUS

[75] Inventor: Angelo L. Tambini, Manor Kilbride, Ireland

[73] Assignee: SPS Technologies, Inc., Jenkintown, Pa.

[21] Appl. No.: 932,061

[22] Filed: Aug. 8, 1978

[51] Int. Cl.[2] ..... B25B 23/14

[52] U.S. Cl. ..... 73/761; 73/139

[58] Field of Search ..... 73/139, 761, 847

[56] References Cited

U.S. PATENT DOCUMENTS

| | | | |
|---|---|---|---|
| 2,889,729 | 6/1959 | Orner | 73/847 X |
| 3,965,778 | 6/1976 | Aspers et al. | 73/761 X |
| 4,000,782 | 1/1977 | Finkelston | 73/139 X |
| 4,091,664 | 5/1978 | Zerver | 73/139 |
| 4,106,176 | 8/1978 | Rice et al. | 73/761 X |

*Primary Examiner*—Charles A. Ruehl

*Attorney, Agent, or Firm*—Aaron Nerenberg

[57] ABSTRACT

The preferred embodiment of the invention disclosed in this application includes a wrench, for example an operator powered wrench, for tightening a fastener assembly by the incremental application of tightening force. Also included is a control circuit for detecting a phenomena indicating that the joint assembly in which the fastener assembly is installed has been tightened to its yield point. The control circuit further includes checking means for determining that the fastener assembly is being tightened to assure that when the phenomena is detected, the joint assembly has been tightened to the yield point.

99 Claims, 5 Drawing Figures

TIGHTENING APPARATUS

BACKGROUND OF THE INVENTION

This invention relates to apparatus for tightening a joint assembly including a fastener assembly to its yield point and, more particularly, to operator powered apparatus or similar apparatus wherein the tightening force is applied incrementally.

Recent advances in the art have provided generally satisfactory methods and apparatus for determining when joints including fastener assemblies have been tightened to the yield point. For example, U.S. Pat. No. 3,982,419 discloses such a method and apparatus, and U.S. Pat. Nos. 3,973,434 and 4,000,782 also disclose such a method and apparatus including checking means for determining certain easily measurable tightening characteristics of the fastener assembly after it has been tightened to the yield point. In view of these advances, tightening to the yield point is becoming more widely used in the manufacture of original equipment.

SUMMARY OF THE INVENTION

This invention has for one of its primary objects, the provision of a tightening apparatus including a wrench for applying tightening force or torque periodically and which further includes control means indicating that the joint has been tightened to its yield point. An example of such a wrench is one wherein the operator applies the tightening torque. When using such wrenches, the operator normally applies tightening torque by rotating the wrench through a limited circumferential extent and then backs the wrench off the fastener and reapplies tightening torque through a similar limited rotary movement. Tightening torque may be so applied to reach the final tightened condition by several such operations.

In providing such an apparatus, several other objects should also be fulfilled. The apparatus should be as simple and economical as possible. In addition, since the apparatus includes means for processing signals representative of various tightening characteristics measured during the tightening cycle, storage means should be provided for storing these signals during the time when the operator is backing the wrench off the fastener in preparation for reapplying tightening torque. Moreover, during the noted time periods when the wrench is being backed off the fastener, the values of the signals being processed are altered to such an extent, (i.e. can drop to zero) that a false indication that the joint has been tightened to the yield point can be developed. Care must be taken to ignore such false indications.

These and other objects of the present invention are accomplished by providing wrench means for applying torque and rotating a fastener member in a joint assembly and by also providing control means for detecting phenomena indicating that the joint assembly has been tightened to its yield point and providing a signal indicating that the phenomena has been detected. Also included is checking means for determining that the fastener is being tightened and providing a signal indicating that it is. The presence of both signals indicates that the joint has been tightened to the yield point.

More particularly, torque and angle measuring means are associated with the wrench means for providing a signal representative of applied torque and rotational displacement of the fastener. Associated with the angle measuring means is incremental rotation detecting means for determining when the fastener has been rotated through a predetermined increment of rotation. The torque signal and the incremental rotation signals are processed to determine when the instantaneous slope of a curve which could be plotted for these parameters is a predetermined percentage of the stored maximum slope of the curve, and a signal indicative of this phenomena is developed. The checking means is responsive to the torque signal and/or the incremental rotation signals to determine that the fastener is being tightened when the phenomena indicating signal is developed.

BRIEF DESCRIPTION OF THE DRAWINGS

For a better understanding of the invention, reference is made to the following description of a preferred embodiment thereof, taken in conjunction with the figures of the accompanying drawing, in which.

DESCRIPTION OF THE PREFERRED EMBODIMENT

Figures 4, 5:
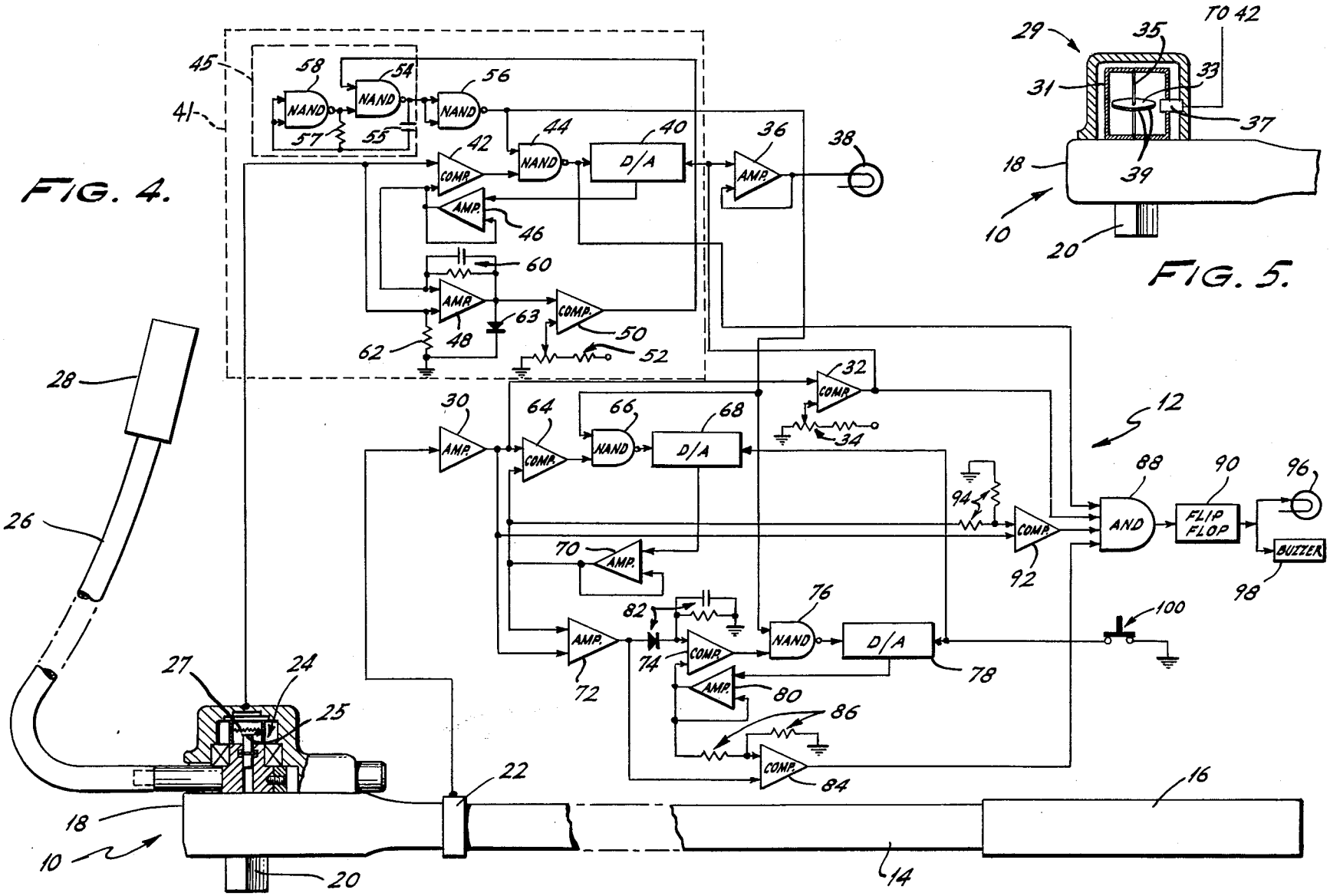
FIG. 4 is a schematic illustration of a tightening apparatus in accordance with this invention.
FIG. 5 is a sectional view in elevation of another embodiment of an angle measuring means.

Referring to FIG. 4 of the drawings, there is illustrated a preferred embodiment of the invention including a generally conventional long-handled ratchet wrench 10 and a control circuit 12 associated with the wrench for providing a signal indicating that the joint assembly in which the fastener is being tightened has reached its yield point. The wrench 10 is operator driven and includes a relatively long-handled member 14 having a hand grip 16 at one end and a driver head 18 at the other end. Extending from one face of the driver head 18 is a coupling member 20 on which is carried a driver tool (not shown) for engaging a fastener. As is conventional, the coupling member 20 is coupled to the driver head 18 through a ratchet arrangement (not shown) such that the coupling member and driver tool are locked to the driver head 18 and handle member 14 during rotary motion in one direction operative to apply tightening torque and impart rotation to tighten the fastener, and such that the driver head and handle member slip relative to the coupling member and driver tool during rotary motion in the opposite direction. Thus, an operator can grip hand grip 16, place the driver tool on a fastener and rotate the tool about an axis normal to the axis of handle member 14. Normally, the operator applies the rotary tightening motion in incremental steps by rotating the fastener through a limited circumferential extent, on the general order of about 120 degrees, and then by rotating the wrench in the opposite direction in preparation for reapplying the tightening torque. Use of a long-handled ratchet wrench is preferred because it facilitates the generation of the relatively high torque required to tighten the fastener, is relatively uncomplicated and, thus, economical. Other types of wrenches including various arrangements providing higher mechanical advantage for transforming the operator force into the relatively high tightening torques required can be utilized, if desired.

Fixed to handle member 14, preferably, relatively close to the driver head 18, is strain gauge means 22 of any generally conventional type capable of producing electrical output signals. The strain gauge means 22 is operative to provide a signal representative of the instantaneous torque being applied to the fastener by measuring the bending strain in the handle member when torque is applied to the fastener. The bending strain is proportional to the bending stress in the handle and the latter is proportional to the direct torque being applied to the fastener.

Connected to the driver head 18 is angle measuring means in the form of a generally conventional potentiometer 24 operative to provide an electrical output signal which is proportional to the rotational displacement of driver head 18. As will be explained hereinafter, this signal is processed to provide signals representative of predetermined incremental rotation of the fastener being tightened. As is customary, potentiometer 24 includes a wiper arm portion 25 and a resistor 27 arranged for relative movement so that the output is variable. Resistor 27 is secured for movement with driver head 18 and wiper arm 25 is held in a fixed position relative to the driver head through the use of a cable 26 and a clip 28. Cable 26 should be of a type that is sufficiently flexible to be bent into a desired shape, but which is also sufficiently plastic to retain that shape once the bending force is removed. One such cable is sold under the trademark "Flexicurve" and comprises a core of lead with strips of steel on opposite faces, all covered with vinyl. Clip 28, which may conveniently be a magnet, is arranged to be placed on a fixed reference member, for example, a portion of the joint assembly being tightened so that wiper arm 25 of the potentiometer, which is directly coupled thereto, is retained in a fixed position. Because of its flexibility, the shape of cable 26 may be varied so that clip 28 can be secured to any conveniently accessible fixed reference point. Thus, with wiper arm 25 held stationary and resistor 27 movable with driver head 18, the output signal from the potentiometer is variable analog signal representative of rotational displacement of the driver head 18 and the fastener being rotated.

Another embodiment of a digital angle measuring means 29 is illustrated in FIG. 5. This apparatus includes a bracket 31 fixed to driver head 18 of the wrench, a high inertia disk 33 mounted on a rod 35 extending between top and bottom portions of bracket 31 on frictionless (or as low friction as possible) bearings, and a transducer 37 such as an optical detector with a built-in light source, secured to the bracket. Disk 33 includes grooves 39 (or markings) on its outer periphery which can be detected by transducer 37 when there is relative motion between the disk and transducer during tightening. Since disk 33 has a high inertia and is mounted on low friction bearings, then any rotation of the driver head containing bracket 31 fixed thereto about the axis of rotation of the disk will cause it to remain fixed, since there will be insufficient torque transmitted through the bearings to start the disk rotating. The relative motion between the disk and transducer 37, which is fixed to the driver head through bracket 31, can thus be measured by the passage of grooves 39, giving an indication of angular movement of the wrench.

Figure 1:
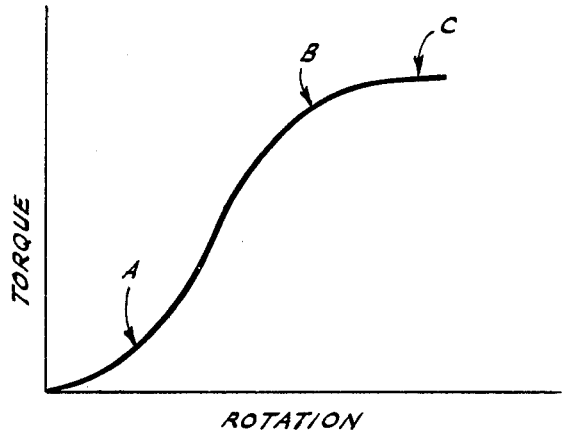
FIG. 1 is a graph illustrating the Torque-Rotation curve for a fastener being tightened.

Having explained wrench 10 and having briefly explained the torque and rotation measuring apparatus, the tightening method will be explained before describing electronic control circuit 12 used to process the signals. As clearly described in U.S. Pat. No. 3,982,419 to Boys, it has been determined that the yield point of a joint assembly including a fastener assembly can be detected by analyzing torque and rotation input information and the resultant torque-rotation curve which could be plotted for the fastener being tightened. Referring to FIG. 1, there is illustrated a typical torque-rotation curve for a threaded fastener being tightened with torque plotted along the vertical axis and rotation plotted along the horizontal axis. The curve includes an initial or pretightening region extending from the intersection of the torque and rotation axes to point A. In the pretightening region, mating threads of the fastener assembly have been engaged and one of the fastener members is being rotated, but the bearing face of the rotating fastener member has not contacted the adjacent face of the structural member included in the joint assembly. At point A on the curve, the structural members have been pulled together by the fastener assembly and actual tightening of the joint assembly. commences. In this tightening region of the curve extending from point A to point B, axial force is developed in the fastener assembly members which is exerted on the structural members as clamping force. In this region, the curve is generally linear. At point B, the limit of proportionality of the joint assembly has been exceeded and the rotation of the fastener member starts increasing faster than the applied torque. For purposes of this application, point B will be considered as the start of the yield region, but it will be understood that beyond point B load will be induced in the joint assembly at a significantly nonlinear rate of increase. Point C corresponds to the yield point of the joint assembly and while the definition of yield point varies somewhat, it can be considered to be the point beyond which strain or stretch of the fastener is no longer purely elastic. By determining when the instantaneous slope of the above-described curve is a predetermined percentage, about 25% to 75%, of the slope of that curve in its tightening region, the yield point can be detected. While the tightening region is generally linear, it may not be exactly linear and may include spikes caused by temporary seizing of the mating thread or variations in lubrication. Thus, the slope in the tightening region may not be a constant, so it is desirable to detect the yield point by determining when the instantaneous slope of the curve is a predetermined percentage of the maximum slope of the curve, as explained in the above-identified Boys patent.

In accordance with this invention, the same general technique is utilized for determining the yield point, with the addition of certain other features to account for the incremental application of torque and the discontinuities in the rotation of the fastener caused by the operator, as explained previously.

Figure 2:
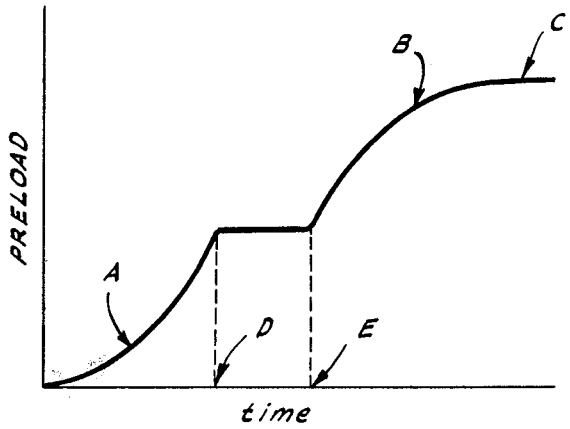
FIG. 2 is a graph illustrating the Preload-time curve for a fastener being tightened by an operator powered wrench.

Referring to FIG. 2, there is a typical Preload-time curve for a threaded fastener being tightened with a hand-operated wrench. In this curve, the preload induced in the fastener is plotted along the vertical axis and time is plotted along the horizontal axis. The corresponding points A, B and C, explained above with respect to FIG. 1, are also indicated on this curve. It can be seen that there is a first time interval from the intersection of the axes to point D in which a first application of tightening torque is made by the operator during which preload increases with time. There is also a second time interval from point D to point E, in which the wrench is being rotated in the opposite direction in preparation for reapplying the torque during which the preload in the fastener remains substantially constant. During a second application of torque by the operator from point E to point C, preload again increases with time as explained above. At the yield point C, tightening should be discontinued. It should be understood that the same time-related characteristics are exhibited when considering rotation of the fastener against time.

Figure 3:
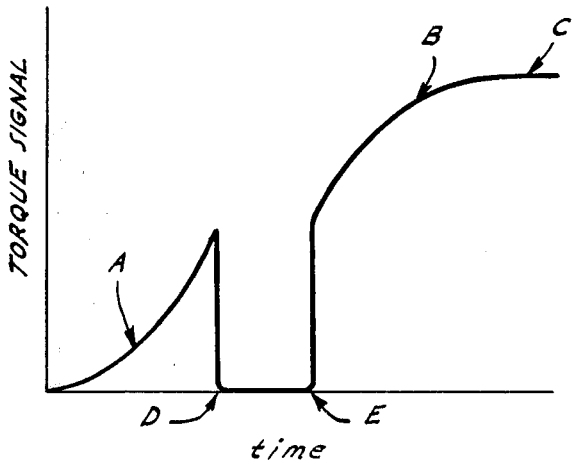
FIG. 3 is a graph illustrating the Torque Signal-time curve for a fastener being tightened by an operator powered wrench including means for measuring the reaction torque on the wrench.

Strain gauge means 22 directly measures the torque being applied to the fastener, and consequently the torque signal drops to zero during periods when the wrench is being rotated in the opposite or reverse direction prior to reapplying the torque. This is clearly illustrated between points D and E in FIG. 3, which is a plot of the torque signal versus time and which also includes corresponding points A through E described above. Thus, in utilizing an operator powered wrench including the torque measuring means described above to determine when a joint has been tightened to its yield point by detecting changes in the torque-rotation curve, care must be taken to assure that control circuitry 12 has not detected a change in the instantaneous slope of the curve based on the fall-off of torque signals during the reverse rotation periods. Accordingly, one aspect of this invention includes a technique for determining that the fastener is actually being tightened when the control circuit indicates that the yield point has been reached. This can be accomplished by providing checking means for determining that the instantaneous torque signal has not dropped below a predetermined percentage of the previous maximum torque signal provided by the strain gauge means, and/or by providing means for determining that the angular rotation of the fastener is increasing. Monitoring the torque or rotation parameters in such a way will provide an indication that the fastener is or is not being tightened when the control circuit otherwise indicates that the yield point has been reached.

Referring again to FIG. 4, it can be seen that the instantaneous torque signal from strain gauge means 22 is fed to an amplifier 30 which magnifies the signal representative of instantaneous torque to a magnitude where it is compatible with the rest of the control system. The amplified torque signal, that is, the output of amplifier 30, is fed to an electronic comparator 32 which receives another input from a potentiometer 34 connected to a voltage source. The purpose of comparator 32 and potentiometer 34 is to provide a signal indicating that the fastener has been tightened into the tightening region, that is, into the respective regions between points A and B on the curves illustrated in FIGS. 1–3. It should be understood that the torque-rotation relationship in the pretightening region is such that a false indication of the yield point could be generated. It is thus desirable to provide an indication that the fastener has been tightened to the tightening region. By setting potentiometer 34 to provide an output signal approximately equal to or slightly in excess of the instantaneous torque signal at point A on the torque-rotation curve, comparator 32 will provide an output signal when the fastener has been tightened into the tightening region of the curve. Precision in determining that point A has been reached is not required and an approximation will suffice. For example, potentiometer 34 can be arranged so that it provides an output signal approximately equal to about 25% to 40% of the torque expected to be applied at the yield point, and this point on the curve will hereinafter be referred to as the "snug" point. The output signal indicating that point A has been reached is fed from comparator 32 to an amplifier 36 which outputs to an indicator means 38, such as a colored light, to provide an indication to the operator that tightening of the joint assembly has commenced. It should be understood, of course, that a variety of different audible, visual or other kinds of indicating devices can be utilized in accordance with this invention.

The output signal from comparator 32 is also fed to a generally conventional digital to analog (D/A) converter 40 and functions to enable the operation of the convertor as will be explained hereinafter. Convertor 40 is operative in incremental rotation detecting means circuit 41 to store signals representative of the largest angle through which the fastener has been tightened. This storage function is accomplished by a counter conventionally incorporated in convertor 40. The signal from angle measuring potentiometer 24 is fed to convertor 40 through a comparator 42 which is in series with a NAND gate 44 which, in turn, is in series with convertor 40. The D/A convertor receives digital signals from NAND gate 44 and is held reset by the logical signal from comparator 32 while the torque is below "snug" point A. When the snug torque value is exceeded, convertor 40 is enabled. The output from convertor 40 is fed to a buffer amplifier 46 the output of which provides the other input to comparator 42. The other input to NAND gate 44 is from an oscillator means 45 which will be explained shortly hereinafter. At this point it is sufficient to note that the oscillator means outputs a series of square waves to NAND gate 44 before the fastener member has been tightened to snug point A. It should be understood that other oscillator means outputting pulses of different shapes could also be utilized. At the snug point, the oscillator means will provide a high output signal and thereafter will output a series of square waves each time the fastener has been rotated through a predetermined angular increment of rotation in the tightening direction.

The instantaneous angle signal from potentiometer 24 is also fed to a differential amplifier 48 which receives as its other input the output from buffer amplifier 46 representative of the maximum angle signal generated and stored at any point in the tightening cycle (from D/A convertor 40). Thus, the output of differential amplifier 48 is a signal equal to the difference between the largest angle signal generated and stored and the instantaneous angle signal. The output signal from differential amplifier 48 is therefore equal to the actual incremental angle through which the fastener has been tightened. It will be remembered that the rotation of the fastener is not continuous, and that when the wrench is rotated in the opposite direction the potentiometer setting will be changed, so that the utilization of the storage function in D/A convertor 40 described above and of differential amplifier 48 accommodates the changes in potentiometer settings during such opposite rotation. From differential amplifier 48, the output signal representative of the actual incremental rotation of the fastener is fed through another comparator 50 which receives as its other input a signal from a signal generating device such as a potentiometer 52. Potentiometer 52 is set so that its output signal is equal to a signal representative of the predetermined increment of angle over which the slope of a torque-rotation curve is to be determined.

The signal from comparator 50 indicating that the fastener has been rotated through a predetermined increment of rotation, is fed to a conventional gated RC oscillator means 45, which generally comprises NAND gates 54 and 58, a capacitor 55 and a resistor 57. NAND gate 54 receives a driving input from comparator 50 and a second input from NAND gate 58, and provides an output to a NAND gate 56 acting as an inverter and through capacitor 55 back to both inputs of NAND gate 58. The output of NAND gate 58 is also fed back through resistor 57 to the inputs of NAND gate 58. Capacitor 55 and resistor 57 produce a time delay which causes NAND gates 54 and 58 to act as an oscillator. Their respective values are chosen in order to determine the desired frequency of oscillation.

To summarize the operation of the circuitry described thus far, when tightening of the fastener commences and prior to reaching snug point A in the tightening cycle, D/A convertor 40 is held reset since it has not received an enabling signal from comparator 32. Thus, convertor 40 provides no output signal and buffer amplifier 46 also provides no output signal. Accordingly, differential amplifier 48 is, at this point, subtracting a zero signal from buffer amplifier 46 from the relatively large output signal from potentiometer 24, and is outputting a relatively large signal to comparator 50. This last mentioned signal is larger than the predetermined incremental angle signal from potentiometer 52 so that the output of comparator 50 is a high signal which is fed to NAND gate 54 and outputs a low signal which is inverted by NAND gate 56 and fed as a high signal to NAND gate 44. The low output signal from NAND gate 54 is also inverted by NAND gate 58 and fed as a high signal to NAND gate 54 driving its output to a high signal which is then inverted by NAND gates 56 and 58, as described above. Thus, oscillator 45 is generating a series of square waves which are fed through inverting NAND gate 56 to NAND gate 44.

Simultaneous with the preceding, potentiometer 24 is feeding its increasing analog signal to comparator 42 which is also receiving the zero output signal from D/A convertor 40, being held reset since it is not yet receiving a signal from comparator 32. Comparator 42 is thus outputting a high signal to NAND gate 44. On each low pulse from NAND gate 56, NAND gate 44 outputs a pulse to D/A convertor 40 which, since it is held reset, cannot store or output the signal.

When snug point A is reached, D/A convertor 40 is enabled by a signal from comparator 32 and starts counting pulses from NAND gate 44. The convertor outputs an analog signal to buffer amplifier 46 and, thus, to comparator 42 and differential amplifier 48. Eventually the output of convertor 40 and buffer amplifier 46 equals the instantaneous angle signal from potentiometer means 24 so that the output of comparator 42 is driven low, but immediately thereafter is driven high as the signal from potentiometer means 24 increases due to further rotation of the fastener. The output signal from buffer amplifier 46 is a function of the stored signal in convertor 40 which signal represents the largest angular rotation of the fastener to that point in the tightening cycle and which is fed to differential amplifier 48 along with the instantaneous angle signal from potentiometer means 24. As noted previously, differential amplifier 48 outputs a signal representative of the increment of rotation through which the fastener has been driven. Initially this difference is relatively small, being less than the signal representative of the predetermined increment of rotation which is provided by potentiometer 52. Thus, the output of comparator 50 is driven low and this low signal is provided to NAND gate 54. With the low signal input to NAND gate 54, it outputs a low signal to inverting NAND gate 56 resulting in a high output signal to NAND gate 44. At this point, both inputs to NAND gate 44 are high so that it provides a low output signal to convertor 40. Thus, the signal stored in convertor 40 is not changed nor is its output, and consequently the output of buffer amplifier 46 is not changed.

When the output of differential amplifier 48 is a signal indicating that the incremental rotation of the fastener equals the predetermined increment of rotation set by the signal from potentiometer 52, comparator 50 outputs a high signal to NAND gate 54 and again starts the oscillator means running. That is, oscillator means 45 again outputs a series of square waves through inverting NAND gate 56. The cycle just described now repeats itself. Convertor 40 again receives pulses from NAND gate 44 until its stored value equals the instantaneous angular rotation signal from potentiometer means 24. Similar to the explanation above, when these signals are equal, the output of differential amplifier 48 is driven to zero and the output of comparator 50 is driven low discontinuing operation of oscillator means 45 by driving the input to NAND gate 54 low.

At this point it is noted that differential amplifier 48 is arranged with a time delay circuit including a resistor and capacitor circuit 60 in parallel altering the input from buffer amplifier 46, and with a grounded resistor 62 and a blocking diode 63 in series altering the input from potentiometer means 24. Because of the capacitor in circuit 60, differential amplifier 48 output signal is delayed so that the oscillator means runs slightly longer than it should. That is, additional output pulses are provided through inverting NAND gate 56. The purpose of these pulses is to allow other storage circuits to stabilize as will be made clear hereinafter.

Referring now to the remainder of the circuitry, from amplifier 30 the instantaneous torque signal is fed through a comparator 64 which provides an output through a NAND gate 66 which receives its other input from NAND gate 56. NAND gate 66 provides an output signal to a storage circuit in the form of a conventional digital to analog (D/A) convertor 68. This arrangement is similar to the arrangement of comparator 42, NAND gate 44 and D/A convertor 40, except that convertor 68 is not held reset below snug point A in the tightening cycle. The output of convertor 68 is fed through a buffer amplifier 70 which, in turn, outputs a signal to comparator 64. Below snug point A in the tightening cycle, NAND gate 56 runs continuously and outputs a series of square wave signals to NAND gate 66. The signal representative of instantaneous torque from amplifier 30 is slightly greater than the output of convertor 68 causing comparator 64 to provide a high output. At each low pulse from NAND gate 56, NAND gate 66 provides an output pulse to convertor 68 driving its stored signal higher and, similarly, the output of buffer amplifier 70. Thus, below snug point A, the respective signals from convertor 68 and buffer amplifier 70 follow the signal representative of instantaneous torque. At the snug point, as explained previously, NAND gate 56 provides a high output signal after a slight time delay, and comparator 64 now provides a high output signal since the signal from amplifier 30 is larger than the signal from buffer amplifier 70, so that NAND gate 66 output is driven low and no new pulses are provided to convertor 68. Thus, a signal representative of the torque at the snug point is stored in convertor 68. The slight time delay noted above, allows the stored signal to stabilize.

Each time comparator 50 determines that the fastener has been rotated through a predetermined angular increment, oscillator means 45 is turned on and NAND gate 56 outputs a series of square waves to NAND gate 66, so that with the output from comparator 64 high, a new signal is fed to convertor 68 and through buffer amplifier 70. In a manner similar to that already explained, NAND gate 66 pulses convertor 68 until the stored signal therein equals the signal representative of instantaneous torque. Thus, beyond snug point A in the tightening cycle, convertor 68 stores and outputs a signal representative of the instantaneous torque being applied at each predetermined increment of rotation. Generally, this signal is representative of the maximum torque applied up till that time, since if the instantaneous torque signal from amplifier 30 does not exceed the stored signal comparator 64 provides no output. Of course, the input to convertor 68 are digital signals and its output is an analog signal.

The output of buffer amplifier 70 is also fed to a differential amplifier 72 which receives as its other input the signal from amplifier 30. The output from differential amplifier 72 is fed to a comparator 74 which outputs to a NAND gate 76 which also receives an input from NAND gate 56. NAND gate 76 provides an output signal to a storage device in the form of a conventional digital to analog (D/A) convertor 78 similar to D/A convertors 40 and 68. Also in a manner similar to D/A convertors 40 and 68, convertor 78 outputs to a buffer amplifier 80 which provides an output back to comparator 74. As will now be explained, D/A convertor 78 stores in digital form and outputs in analog form, a signal representative of the largest slope at any point in the tightening cycle of the torque-rotation curve which could be plotted for the fastener being tightened.

Below snug point A in the tightening cycle, a signal representative of instantaneous torque is fed to differential amplifier 72 from amplifier 30, and a signal approximately equal to the maximum torque applied at that point is also fed to differential amplifier 72 from convertor 68 through buffer amplifier 70. Thus, the output of differential amplifier 72 is essentially zero. With no input to comparator 74, it has no output and NAND gate 76 provides no output to D/A convertor 78. At snug point A in the tightening cycle, the inputs to comparator 74 are still essentially equal so that D/A convertor 78 still does not receive an input signal. It is noted, however, that the input from inverting NAND gate 56 to NAND gate 76 is now driven high, as previously explained. Immediately after snug point A has been reached, the signal from amplifier 30 starts to exceed the stored signal from convertor 68 and buffer amplifier 70 so that the output from differential amplifier 72 starts to increase, reflecting the difference between the instantaneous torque and stored torque causing comparator 74 to output a high signal to NAND gate 76. With two high inputs, of course, NAND gate 76 provides no output to convertor 78.

As soon as comparator 50 detects that the fastener has been tightened through a predetermined increment of rotation, oscillator means 45 is again turned on and inverting NAND gate 56 outputs a series of square waves to NAND gate 76. At this same time, differential amplifier 72 is outputting a signal representative of the difference between the signal from amplifier 30, representative of the instantaneous torque being applied at that increment of rotation, and the signal from convertor 68 and buffer amplifier 70, representative of the torque at snug point A. Accordingly, the output of differential amplifier 72 is a signal representative of the slope of the torque-rotation curve over that predetermined increment of rotation. With no signal from D/A convertor 78 and buffer amplifier 80, the output of differential amplifier 72 causes comparator 74 to output to NAND gate 76. On each low pulse from NAND gate 56, NAND gate 76 provides an output pulse to convertor 78. When the output from convertor 78 and buffer amplifier 80 equals the signal from differential amplifier 72, comparator 74 discontinues its output and the signal stored in convertor 78 is representative of the slope of the curve over that first predetermined increment of rotation. Thereafter, at each predetermined increment when the instantaneous slope of the curve is larger than the stored previous largest slope of the curve, the just described process repeats so that convertor 78 always stores and outputs a signal representative of the maximum slope of the torque-rotation curve up to that point in the tightening cycle.

In the preferred embodiment of the invention disclosed herein, a temporary storage circuit 82 is associated with comparator 74 and includes a grounded capacitor and a resistor in parallel with the comparator and a diode between differential amplifier 72 and the input to comparator 74. Storage circuit 82 temporarily stores the signal from differential amplifier 72 to assure that the signal representative of the slope of the curve is fed to comparator 74 and not the signal being generated when the square wave pulses are being emitted from oscillator means 45. Since these pulses also cause convertor 68 to update the stored instantaneous torque reading, the output from this convertor and its buffer amplifier 70 immediately start to increase and change the output of differential amplifier 72.

The signal in convertor 78, representative of the maximum slope of the curve at any point, and the signal from differential amplifier 72, representative of instantaneous slope of the curve, are fed to an additional comparator 84 to determine when the instantaneous slope is a predetermined percentage of the stored maximum slope. To accomplish this determination, a divider circuit 86 is provided including a grounded resistor in parallel with comparator 84 and a resistor between buffer amplifier 80 and the input to comparator 84. Thus, the predetermined percentage between 25% to 75%, and normally 50% of the signal from convertor 78 and buffer amplifier 80 is fed to comparator 84. Accordingly, when the signal from differential amplifier 72, representative of the instantaneous slope of the curve, equals or exceeds the predetermined percentage of the stored signal fed to comparator 84, the comparator provides an output signal indicating that the instantaneous slope of the curve signal is equal to the predetermined percentage of the maximum slope of the curve signal.

If the torque were applied continuously, the output signal from comparator 84 would indicate that the joint assembly has been tightened to its yield point. However, when the torque is applied incrementally as with hand operated wrench 10, the torque signal from strain gauge means 22 decreases during periods of rotation in the opposite direction as illustrated at point D in FIG. 3. At each such point D in a tightening cycle, comparator 84 outputs a signal. Thus, there is provided checking means for determining that the yield point has been reached. Included in the checking means circuitry is a four input AND gate 88 providing an output signal to a flip-flop 90. AND gate 88 receives one input from comparator 32 indicating that torque is being applied at that moment and that snug point A has been reached, and another input from comparator 84 indicating that the instantaneous gradient signal is a predetermined percentage of the maximum gradient signal to that point. Since a detection that the yield point has been reached can only be made at each increment of rotation, AND gate 88 also receives an input from NAND gate 44, it being remembered that this gate provides output pulses continuously below the snug point and, thereafter, only at the predetermined increments of rotation. If signals from both comparator 32 and NAND gate 44 are detected, it can be assured that the fastener has just been rotated through a predetermined increment of rotation. Also, a detection of the yield point can only be made when significant torque is being applied to the fastener. Thus, the instantaneous torque signal from amplifier 30 is fed to one input of a comparator 92 which also receives at a second input a signal representative of the predetermined percentage of the maximum torque from convertor 68 and buffer amplifier 70. This is accomplished by providing a divider circuit 94 in the form of two resistors in series between the output of buffer amplifier 70 and the input to comparator 92. One resistor is grounded and the other resistor is not grounded. Thus, the one input to comparator 92 is representative of instantaneous torque and the other input is representative of the predetermined percentage of the maximum torque applied up till any point in time. It has been found that the predetermined percentage should be about $66\frac{2}{3}\%$ so that two-thirds of the maximum torque signal is fed to comparator 92. If the instantaneous torque signal is at least two-thirds of the maximum torque signal, comparator 92 provides an output signal which is fed to the four input AND gate 88. When all four conditions are met, then all four signals are fed to AND gate 88 and it outputs a signal to flip-flop 90 indicating that the joint assembly has been tightened to its yield point. Flip-flop 90 stores the signal from AND gate 88 and drives an indicator in the form of a light 96 and/or a buzzer 98, thus indicating to the operator to discontinue tightening of the joint assembly. A reset switch 100 is provided to clear D/A convertors 68 and 78 at the end of each tightening cycle.

From the preceding description, the operation of the wrench 10 and control circuit 12 should be clear. It should be noted, however, that from points D to E in the tightening cycle, as driver head 18 is rotated in the reverse direction, resistor 27 is also rotated in the reverse direction changing the signal from potentiometer 24. Thus, then tightening torque is reapplied at point E, the potentiometer signal representative of the angular rotation of the fastener which is stored in D/A convertor 40 is zero. At point D the instantaneous torque signal from strain gauge means 22 drops below the signal representative of the torque at snug point A which is fed to comparator 32 from potentiometer 34. Accordingly, comparator 32 provides no signal to convertor 40 so that the convertor is held reset and its stored signal drops to zero. Thus, at point E in the tightening cycle, the new signal from potentiometer 24 is processed as if the tightening cycle had just begun (as previously described) in order to determine when the fastener has been rotated through predetermined increments of rotation. One other point of note is that if point D occurs between predetermined increments of rotation, the signal stored in convertor 68 representative of the instantaneous torque at the last predetermined increment of rotation is lower than the instantaneous torque applied to the fastener at point E. It should be understood that due to the mode of operation of the incremental rotation detecting circuitry, the incremental angle is measured from point E, not the last increment of rotation detected. To account for this difference in torque, time delay circuit 60 associated with differential amplifier 48 comes into effect. As noted, the time delay circuit causes oscillator means 45 to provide additional output pulses through inverting NAND gate 56 after differential amplifier 48 detects an increment of rotation. Thus, these additional pulses drive NAND gate 66 and allow D/A convertor 68 to continue to receive signals from comparator 64, and the signal stored in D/A convertor 68 is driven higher to approximate the actual instantaneous torque being applied to the fastener at point E. While this is not an exact technique, it is sufficiently close so that the accuracy of the method performed by the apparatus is not significantly impaired.

It should be pointed out that the operator should exercise some care in using the apparatus. Short jerky application of torque should be avoided and torque should be applied as smoothly as possible.

While in the foregoing a preferred embodiment of the invention has been disclosed, various modifications and changes will occur to those skilled in the art without departing from the true spirit and scope of the invention as recited in the appended claims.

I claim:

1. Apparatus for tightening a joint assembly including a fastener assembly to its yield point wherein the tightening force is applied incrementally, said apparatus comprising:

wrench means for applying the tightening force in the form of torque in increments separated by periods when the tightening force is not applied to and for rotating a fastener member; and control means operatively associated with said wrench means for providing a control signal and including means for detecting a phenomena indicative of the yield point of the joint assembly and for providing a first indicating signal when said phenomena is detected;

said control means further including checking means for determining that the fastener member is being tightened during an increment of tightening force application and for providing a second indicating signal indicative thereof, wherein said checking means receives said first indicating signal and further includes gate means responsive to said first and second indicating signals for providing said control signal.

2. Apparatus in accordance with claim 1 wherein said checking means determines that the angular rotation of the fastener assembly is increasing in the tightening direction.

3. Apparatus in accordance with claim 2 wherein said checking means further includes means for determining that a minimum predetermined torque is being applied to the fastener and for providing a third indicating signal indicative thereof, said checking means gate means being responsive to said first, second and third indicating signals.

4. Apparatus in accordance with claim 1 wherein said checking means further includes means for determining that the instantaneous torque being applied to the fastener at any point in the tightening cycle is at least a predetermined percentage of the maximum torque applied up to that point in the tightening cycle and for providing a fourth indicating signal indicative thereof, said checking means gate means being responsive to said first, second and fourth indicating signals.

5. Apparatus in accordance with claim 4 wherein said predetermined percentage is between about 25% to 75%.

6. Apparatus in accordance with claim 4 wherein said predetermined percentage is about $66\frac{2}{3}$%.

7. Apparatus in accordance with claim 4 wherein said checking means determines that the fastener is being rotated in the tightening direction by determining that a predetermined increment of rotation has been detected.

8. Apparatus in accordance with claim 7 wherein said checking means further includes means for determining that the fastener has been tightened into the tightening region of the torque-rotation curve that could be plotted for the fastener being tightened and for providing a third indicating signal indicative thereof, said checking means gate means being responsive to said first, second, third and fourth indicating signals.

9. Apparatus in accordance with claim 7 wherein said checking means further includes means for determining that a predetermined minimum torque is being applied to the fastener and for providing a third indicating signal indicative thereof, said checking means gate means being responsive to said first, second, third and fourth indicating signals.

10. Apparatus in accordance with claim 1 including torque measuring means for measuring the torque being applied to the fastener and for providing a signal representative thereof, angle measuring means for measuring rotational displacement of the fastener and providing a signal representative thereof, and wherein said checking means includes incremental rotation detecting means for determining when the fastener has been rotated through a predetermined increment of rotation and providing said second indicating signal each time the fastener has been rotated through said predetermined increment of rotation.

11. Apparatus in accordance with claim 10 wherein said incremental rotation detecting means includes oscillator means operative to provide a series of output pulses each time a predetermined increment of rotation signal is provided.

12. Apparatus in accordance with claim 11 wherein said incremental rotation detecting means includes storage means operative to receive rotational displacement signals each time said oscillator means provides a pulse and for providing an output signal representative of said stored rotational displacement signals, means for subtracting said storage means output signal from said rotational displacement signal and outputting a signal representative of the difference therebetween and comparator means responsive to said difference signal for determining when said difference signal is equal to a signal representative of the predetermined increment of rotation and for providing a signal operative to enable said oscillator means.

13. Apparatus in accordance with claim 12 including means holding said storage means inoperative when the value of said torque signal is less than a predetermined value.

14. Apparatus in accordance with claim 11 wherein said control means further includes storage means operative to receive torque signals each time said oscillator means provides a pulse for providing an output signal representative of said stored torque signals and means for subtracting said output signal from said torque signal and outputting a signal representative of the difference therebetween.

15. Apparatus in accordance with claim 14 wherein time delay means is operatively associated with said oscillator means so that additional pulses are provided by said oscillator means after a predetermined increment of rotation signal is provided.

16. Apparatus in accordance with claim 14 wherein said control means further includes additional storage means operative to receive said difference signal each time said oscillator means provides a pulse if said difference signal is larger than the previously stored signal for providing an output signal representative of said stored difference signals, and means for determining when said difference signal is a predetermined percentage of said stored difference signals.

17. Apparatus in accordance with claim 11 wherein said incremental rotation detecting means includes first storage means operative to receive rotational displacement signals each time said oscillator means provides a pulse for providing first output signal representative of said stored rotational displacement signals, means for subtracting said first output signal from said rotational displacement signal and outputting a first signal representative of the difference therebetween and first comparator means responsive to said first difference signal for determining when said first difference signal is equal to a signal representative of the predetermined increment of rotation and for providing a signal operative to enable said oscillator means, said control means further including second storage means operative to receive torque signals each time said oscillator means provides a pulse for providing a second output signal representative of said stored torque signals, second means for subtracting said second output signal from said torque signal and outputting a second signal representative of the difference therebetween, third storage means operative to receive said second difference signals each time said oscillator means provides a pulse if said second difference signal is larger than the signal previously stored in said third storage means for providing a third output signal representative of said stored second difference signals, and means for determining when said third output signal is a predetermined percentage of said second output signal.

18. Apparatus for tightening a joint assembly including a fastener assembly to a predetermined tightened condition, said apparatus comprising:

wrench means for applying torque to and rotating a fastener;

control means operatively associated with said wrench means for detecting the predetermined tightened condition and providing an output indicative thereof, said control means including measuring means for measuring rotational displacement of the fastener and providing a signal representative thereof and incremental rotation detecting means for determining when said fastener has been rotated through predetermined increments of rotation and for providing a signal indicative thereof; said incremental rotation detecting means including oscillator means operative to provide a series of output pulses, first comparator means and storage means, said first comparator means being arranged to receive said rotational displacement signal and a signal from said storage means for providing an output signal to gating means when said rotational displacement signal is larger than the signal from said storage means, subtracting means arranged to receive said rotational displacement signal and said signal from said storage means for providing an output signal representative of the difference therebetween, second comparator means operative to determine when said difference signal is a predetermined magnitude for providing an output signal to said oscillator means, said oscillator means providing a series of pulses to said gating means whereby said gating means outputs pulses to said storage means when it receives signals from said first comparator means and said oscillator means.

19. Apparatus in accordance with claim 18 wherein said storage means comprises a digital to analog convertor.

20. Apparatus in accordance with claim 18 wherein said control means includes means for determing when the instantaneous torque being applied to the fastener is less than a predetermined torque and providing a signal holding said storage means inoperative when this condition is met.

21. Apparatus for tightening a joint assembly including a fastener assembly, said apparatus comprising wrench means including a driver head adapted to be rotated and to tighten a fastener, and potentiometer means associated with said driver head for providing a signal representative of the rotation thereof, said potentiometer means including a resistor portion and a wiper arm portion, one of said portions being arranged to rotate with said driver head and the other of said portions being associated with retaining means for attaching said other portion to a fixed reference member for holding said other portion from rotating.

22. Apparatus in accordance with claim 21 wherein said retaining means includes a flexible member carried by said other of said portions and further includes a clip for fixing said flexible member to the fixed reference member.

23. Apparatus in accordance with claim 22 wherein said flexible member is a cable.

24. Apparatus in accordance with claim 22 wherein said clip comprises a magnet.

25. A control system usable in apparatus for tightening a joint assembly including a fastener assembly to its yield point wherein the tightening force is applied incrementally in the form of torque, comprising:

control means formed to be operatively associated with the tightening apparatus for providing a control signal and including means for detecting a phenomena indicative of the yield point of the joint assembly and for providing a first indicating signal when said phenomena is detected; said control means further including checking means for determining that the fastener assembly is being tightened during an increment of tightening force application and for providing a second indicating signal indicative thereof, wherein said checking means receives said first indicating signal and further includes gate means responsive to said first and second indicating signals for providing said control signal.

26. A control system in accordance with claim 25 wherein said checking means determines that the angular rotation of the fastener assembly is increasing in the tightening direction.

27. A control system in accordance with claim 26 wherein said checking means further includes means for determining that a minimum predetermined torque is being applied to the fastener assembly and for providing a third indicating signal indicative thereof, said checking means gate means being responsive to said first, second and third indicating signals.

28. A control system in accordance with claim 25 wherein said checking means further includes means for determining that the instantaneous torque being applied to the fastener assembly is at least a predetermined percentage of the maximum torque applied up to that point in the tightening cycle and for providing a fourth indicating signal indicative thereof, said checking means gate means being responsive to said first, second and fourth indicating signals.

29. A control system in accordance with claim 28 wherein said predetermined percentage is between about 25% to 75%.

30. A control system in accordance with claim 28 wherein said predetermined percentage is about 66⅔%.

31. A control system in accordance with claim 28 wherein said checking means determines that the fastener assembly is being rotated in the tightening direction by determining that a predetermined increment of rotation has been detected.

32. A control system in accordance with claim 31 wherein said checking means further includes means for determining that the fastener assembly has been tightened into the tightening region of the torque-rotation curve that could be plotted for the fastener assembly being tightened and for providing a third indicating signal indicative thereof, said checking means gate means being responsive to said first, second, third and fourth indicating signals.

33. A control system in accordance with claim 31 wherein said checking means further includes means for determining that a predetermined minimum torque is being applied to the fastener assembly and for providing a third indicating signal indicative thereof, said checking means gate means being responsive to said first, second, third and fourth indicating signals.

34. A control system in accordance with claim 25 including torque measuring means for measuring the reaction torque on said wrench means and for providing a signal representative thereof, angle measuring means for measuring rotational displacement of the fastener assembly and providing a signal representative thereof, and wherein said checking means includes incremental rotation detecting means for determining when the fastener assembly has been rotated through a predetermined increment of rotation and providing said second indicating signal each time the fastener assembly has been rotated through said predetermined increment of rotation.

35. A control system in accordance with claim 34 wherein said incremental rotation detecting means includes oscillator means operative to provide a series of output pulses each time a predetermined increment of rotation signal is provided.

36. A control system in accordance with claim 35 wherein said incremental rotation detecting means includes storage means operative to receive rotational displacement signals each time said oscillator means provides a pulse and to provide an output signal representative of said stored rotational displacement signals, means for subtracting said storage means output signal from said rotational displacement signal and outputting a signal representative of the difference therebetween and comparator means responsive to said difference signal for determining when said difference signal equals a signal representative of the predetermined increment of rotation and for providing a signal operating said oscillator means.

37. A control system in accordance with claim 36 including means holding said storage means inoperative when said torque signal is less than a predetermined torque signal.

38. A control system in accordance with claim 36 wherein said control means further includes storage means operative to receive torque signals each time said oscillator means provides a pulse and to provide an output signal representative of said stored torque signals and means for subtracting said output signal from said torque signal and outputting a signal representative of the difference therebetween.

39. A control system in accordance with claim 38 wherein time delay means is operatively associated with said oscillator means to that additional pulses are provided by said oscillator means after a predetermined increment of rotation signal is provided.

40. A control system in accordance with claim 38 wherein said control means further includes additional storage means operative to receive said difference signal each time said oscillator means provides a pulse if said difference signal is larger than the previously stored signal and to provide an output signal representative of said stored difference signals, and means for determining when said difference signal is a predetermined percentage of said stored difference signals.

41. A control system in accordance with claim 35 wherein said incremental rotation detecting means includes first storage means operative to receive rotational displacement signals each time said oscillator means provides a pulse and to provide a first output signal representative of said stored rotational displacement signals, means for subtracting said first output signal from said rotational displacement signal and outputting a first signal representative of the difference therebetween and first comparator means responsive to said first difference signal for determining when said first difference signal equals a signal representative of the predetermined increment of rotation and for providing a signal operating said oscillator means, said control means further including second storage means operative to receive torque signals each time said oscillator means provides a pulse and to provide a second output signal representative of said stored torque signals, second means for subtracting said second output signal from said torque signal and outputting a second signal representative of the difference therebetween, third storage means operative to receive second difference signals each time said oscillator means provides a pulse if said second difference signal is larger than the signal previously stored in said third storage means and to provide a third output signal representative of said stored second difference signals, and means for determining when said third output signal is a predetermined percentage of said second output signal.

42. Apparatus for tightening a joint assembly including a fastener assembly to its yield point said apparatus comprising:

wrench means for applying torque to an rotating a fastener member; and control means operatively associated with said wrench means for providing a control signal and including means for detecting a phenomena indicative of the yield point of the joint assembly and for providing a first indicating signal when said phenomena is detected;

said control means further including checking means first means for determining that the fastener member is being tightened and for providing a second indicating signal indicative thereof, said checking means further including second means for determining that the instantaneous torque being applied to the fastener assembly at any point in the tightening cycle is at least a predetermined percentage of the maximum torque applied up to that point in the tightening cycle and for providing a third indicating signal indicative thereof, wherein said checking means receives said first indicating signal and further includes gate means responsive to said first, second and third indicating signals for providing said control signal.

43. Apparatus in accordance with claim 42 wherein said checking means includes means for determining that the angular rotation of the fastener assembly is increasing in the tightening direction.

44. Apparatus in accordance with claim 42 wherein said predetermined percentage is between about 25% to 75%.

45. Apparatus in accordance with claim 42 wherein said predetermined percentage is about $66\frac{2}{3}$%.

46. Apparatus in accordance with claim 42 wherein said checking means first means determines that the fastener is being rotated in the tightening direction by determining that a predetermined increment of rotation has been detected.

47. Appratus in accordance with claim 46 wherein said checking means further includes third means for determining that the fastener has been tightened into the tightening region of the torque-rotation curve that could be plotted for the fastener being tightened and for providing a fourth indicating signal indicative thereof, said checking means gate means being responsive to said first, second, third and fourth indicating signals.

48. Apparatus in accordance with claim 46 wherein said checking means further includes third means for determining that a predetermined minimum torque is being applied to the fastener and for providing a fourth indicating signal indicative thereof, said checking means gate means being responsive to said first, second, third and fourth indicating signals.

49. Apparatus in accordance with claim 42 including torque measuring means for measuring the torque being applied to the fastener and for providing a signal representative thereof, angle measuring means for measuring rotational displacement of the fastener and providing a signal representative thereof, and wherein said checking means first means includes incremental rotation detecting means for determining when the fastener has been rotated through a predetermined increment of rotation and providing said second indicating signal each time the fastener has been rotated through said predetermined increment of rotation.

50. Apparatus in accordance with claim 49 wherein said incremental rotation detecting means includes oscillator means operative to provide a series of output pulses each time a predetermined increment of rotation signal is provided.

51. Apparatus in accordance with claim 50 wherein said incremental rotation detecting means includes storage means operative to receive rotational displacement signals each time said oscillator means provides a pulse and for providing an output signal representative of said stored rotational displacement signals, means for subtracting said storage means output signal from said rotational displacement signal and outputting a signal representative of the difference therebetween and comparator means responsive to said difference signal for determining when said difference signal is equal to a signal representative of the predetermined increment of rotation and for providing a signal operative to enable said oscillator means.

52. Apparatus in accordance with claim 51 including means holding said storage means inoperative when the value of said torque signal is less than a predetermined value.

53. Apparatus in accordance with claim 50 wherein said control means further includes storage means operative to receive torque signals each time said oscillator means provides a pulse for providing an output signal representative of said stored torque signals and means for subtracting said output signal from said torque signal and outputting a signal representative of the difference therebetween.

54. Apparatus in accordance with claim 53 wherein time delay means is operatively associated with said oscillator means so that additional pulses are provided by said oscillator means after a predetermined increment of rotation signal is provided.

55. Apparatus in accordance with claim 53 wherein said control means further includes additional storage means operative to receive said difference signal each time said oscillator means provides a pulse if said difference signal is larger than the previously stored signal for providing an output signal representative of said stored difference signals, and means for determining when said difference signal is a predetermined percentage of said stored difference signals.

56. Apparatus in accordance with claim 50 wherein said incremental rotation detecting means includes first storage means operative to receive rotational displacement signals each time said oscillator means provides a pulse for providing first output signal representative of said stored rotational displacement signals, means for subtracting said first output signal from said rotational displacement signal and outputting a first signal representative of the difference therebetween and first comparator means responsive to said first difference signal for determining when said first difference signal is equal to a signal representative of the predetermined increment of rotation and for providing a signal operative to enable said oscillator means, said control means further including second storage means operative to receive torque signals each time said oscillator means provides a pulse for providing a second output signal representative of said stored torque signals, second means for subtracting said second output signal from said torque signal and outputting a second signal representative of the difference therebetween, third storage means operative to receive said second difference signals each time said oscillator means provides a pulse if said second difference signal is larger than the signal previously stored in said third storage means for providing a third output signal representative of said stored second difference signals, and means for determining when said third output signal is a predetermined percentage of said second output signal.

57. Apparatus for tightening a joint assembly including a fastener assembly to its yield point, said apparatus comprising:

wrench means for applying torque to and rotating a fastener member; and control means operatively associated with said wrench means for providing a control signal and including means for detecting a phenomena indicative of the yield point of the joint assembly and for providing a first indicating signal when said phenomena is detected;

said control means further including checking means first means for determining that the fastener member is being rotated in the tightening direction by determining that a predetermined increment of rotation has been detected and providing a second indicating signal indicative thereof, said checking means further including second means for determining that torque is being applied and providing a third indicating signal indicative thereof, wherein said checking means receives said first indicating signal and further includes gate means responsive to said first, second and third indication signals for providing said control signal.

58. Apparatus in accordance with claim 57 wherein said checking means second means determines that a minimum predetermined torque is being applied to the fastener.

59. Apparatus in accordance with claim 57 wherein said checking means further includes means for determining that the instantaneous torque being applied to the fastener at any point in the tightening cycle is at least a predetermined percentage of the maximum torque applied up to that point in the tightening cycle and for providing a fourth indicating signal indicative thereof, said checking means gate means being responsive to said first, second, third and fourth indicating signals.

60. Apparatus in accordance with claim 59 wherein said predetermined percentage is between about 25% to 75%.

61. Apparatus in accordance with claim 59 wherein said predetermined percentage is about $66\frac{2}{3}$%.

62. Apparatus in accordance with claim 57 wherein said checking means second means determines that the fastener has been tightened into the tightening region of the torque-rotation curve that could be plotted for the fastener being tightened.

63. Apparatus in accordance with claim 57 including torque measuring means for measuring the torque being applied to the fastener and for providing a signal representative thereof, angle measuring means for measuring rotational displacement of the fastener and providing a signal representative thereof, said checking means first means providing said second indicating signal each time the fastener has been rotated through said predetermined increment of rotation.

64. Apparatus in accordance with claim 63 wherein said checking means first means includes oscillator means operative to provide a series of output pulses each time a predetermined increment of rotation signal is provided.

65. Apparatus in accordance with claim 64 wherein said checking means first means includes storage means operative to receive rotational displacement signals each time said oscillator means provides a pulse and for providing an output signal representative of said stored rotational displacement signals, means for subtracting said storage means output signal from said rotational displacement signal and outputting a signal representative of the difference therebetween and comparator means responsive to said difference signal for determining when said difference signal is equal to a signal representative of the predetermined increment of rotation and for providing a signal operative to enable said oscillator means.

66. Apparatus in accordance with claim 65 including means holding said storage means inoperative when the value of said torque signal is less than a predetermined value.

67. Apparatus in accordance with claim 64 wherein said control means further includes storage means operative to receive torque signals each time said oscillator means provides a pulse for providing an output signal representative of said stored torque signals and means for subtracting said output signal from said torque signal and outputting a signal representative of the difference therebetween.

68. Apparatus in accordance with claim 67 wherein time delay means is operatively associated with said oscillator means so that additional pulses are provided by said oscillator means after a predetermined increment of rotation signal is provided.

69. Apparatus in accordance with claim 67 wherein said control means further includes additional storage means operative to receive said difference signal each time said oscillator means provides a pulse if said difference signal is larger than the previously stored signal for providing an output signal representative of said stored difference signals, and means for determining when said difference signal is a predetermined percentage of said stored difference signals.

70. Apparatus in accordance with claim 64 wherein said checking means first means includes first storage means operative to receive rotational displacement signals each time said oscillator means provides a pulse for providing a first output signal representative of said stored rotational displacement signals, means for subtracting said first output signal from said rotational displacement signal and outputting a first signal representative of the difference therebetween and first comparator means responsive to said first difference signal for determining when said first difference signal is equal to a signal representative of the predetermined increment of rotation and for providing a signal operative to enable said oscillator means, said control means further including second storage means operative to receive torque signals each time said oscillator means provides a pulse for providing a second output signal representative of said stored torque signals, second means for subtracting said second output signal from said torque signal and outputting a second signal representative of the difference therebetween, third storage means operative to receive said second difference signals each time said oscillator means provides a pulse if said second difference signal is larger than the signal previously stored in said third storage means for providing a third output signal representative of said stored second difference signals, and means for determining when said third output signal is a predetermined percentage of said second output signal.

71. A control system usable in apparatus for tightening a joint assembly including a fastener assembly to its yield point, comprising:

control means formed to be operatively associated with the tightening apparatus for providing a control signal and including means for detecting a phenomena indicative of the yield point of the joint assembly and for providing a first indicating signal when said phenomena is detected;

said control means further including checking means first means for determining that the fastener assembly is being tightened and for providing a second indicating signal indicative thereof, said checking means further including second means for determining that the instantaneous torque being applied to the fastener assembly is at least a predetermined percentage of the maximum torque applied up to that point in the tightening cycle and for providing a third indicating signal indicative thereof, wherein said checking means receives said first indicating signal and further includes gate means responsive to said first, second and third indicating signals for providing said control signal.

72. A control system in accordance with claim 71 wherein said checking means first means determines that the angular rotation of the fastener assembly is increasing in the tightening direction.

73. A control system in accordance with claim 71 wherein said predetermined percentage is between about 25% to 75%.

74. A control system in accordance with claim 71 wherein said predetermined percentage is about $66\frac{2}{3}$%.

75. A control system in accordance with claim 71 wherein said checking means first means determines that the fastener assembly is being rotated in the tightening direction by determining that a predetermined increment of rotation has been detected.

76. A control system in accordance with claim 75 wherein said checking means further includes third means for determining that the fastener assembly has been tightened into the tightening region of the torque-rotation curve that could be plotted for the fastener assembly being tightened and for providing a fourth indicating signal indicative thereof, said checking means gate means being responsive to said first, second, third and fourth indicating signals.

77. A control system in accordance with claim 75 wherein said checking means further includes third means for determining that a predetermined minimum torque is being applied to the fastener assembly and for providing a fourth indicating signal indicative thereof, said checking means gate means being responsive to said first, second, third and fourth indicating signals.

78. A control system in accordance with claim 71 including torque measuring means for measuring the reaction torque on said wrench means and for providing a signal representative thereof, angle measuring means for measuring rotational displacement of the fastener assembly and providing a signal representative thereof, and wherein said checking means first means includes incremental rotation detecting means for determining when the fastener assembly has been rotated through a predetermined increment of rotation and providing said second indicating signal each time the fastener assembly has been rotated through said predetermined increment of rotation.

79. A control system in accordance with claim 78 wherein said incremental rotation detecting means includes oscillator means operative to provide a series of output pulses each time a predetermined increment of rotation signal is provided.

80. A control system in accordance with claim 79 wherein said incremental rotation detecting means includes storage means operative to receive rotational displacement signals each time said oscillator means provides a pulse and to provide an output signal representative of said stored rotational displacement signals, means for subtracting said storage means output signal from said rotational displacement signal and outputting a signal representative of the difference therebetween and comparator means responsive to said difference signal for determining when said difference signal equals a signal representative of the predetermined increment of rotation and for providing a signal operating said oscillator means.

81. A control system in accordance with claim 80 including means holding said storage means inoperative when said torque signal is less than a predetermined torque signal.

82. A control system in accordance with claim 80 wherein said control means further includes storage means operative to receive torque signals each time said oscillator means provides a pulse and to provide an output signal representative of said stored torque signals and means for subtracting said output signal from said torque signal and outputting a signal representative of the therebetween.

83. A control system in accordance with claim 82 wherein time delay means is operatively associated with said oscillator means so that additional pulses are provided by said oscillator means after a predetermined increment of rotation signal is provided.

84. A control system in accordance with claim 82 wherein said control means further includes additional storage means operative to receive said difference signal each time said oscillator means provides a pulse if said difference signal is larger than the previously stored signal and to provide an output signal representative of said stored difference signals, and means for determining when said difference signal is a predetermined percentage of said stored difference signals.

85. A control system in accordance with claim 79 wherein said incremental rotation detecting means includes first storage means operative to receive rotational displacement signals each time said oscillator means provides a pulse and to provide a first output signal representative of said stored rotational displacement signals, means for subtracting said first output signal from said rotational displacement signal and outputting a first signal representative of the difference therebetween and first comparator means responsive to said first difference signal for determining when said first difference signal equals a signal representative of the predetermined increment of rotation and for providing a signal operating said oscillator means, said control means further including second storage means operative to receive torque signals each time said oscillator means provides a pulse and to provide a second output signal representative of said stored torque signals, second means for subtracting said second output signal from said torque signal and outputting a second signal representative of the difference therebetween, third storage means operative to receive second difference signals each time said oscillator means provides a pulse if said second difference signal is larger than the signal previously stored in said third storage means and to provide a third output signal representative of said stored second difference signals, and means for determining when said third output signal is a predetermined percentage of said second output signal.

86. A control system usable in apparatus for tightening a joint assembly including a fastener assembly to its yield point, comprising:

control means formed to be operatively associated with the tightening apparatus for providing a control signal and including means for detecting a phenomena indicative of the yield point of the joint assembly and for providing a first indicating signal when said phenomena is detected:

said control means further including checking means first means for determining that the fastener assembly is being rotated in the tightening direction by determining that a predetermined increment of rotation has been detected and providing a second indicating signal indicative thereof, said checking means further including second means for determining that torque is being applied and providing a third indicating signal indicative thereof, wherein said checking means receives said first indicating signal and further includes gate means responsive to said first, second and third indicating signals for providing said control signal.

87. A control system in accordance with claim 86 wherein said checking means second means determines that a minimum predetermined torque is being applied to the fastener assembly.

88. A control system in accordance with claim 86 wherein said checking means further includes means for determining that the instantaneous torque being applied to the fastener assembly is at least a predetermined percentage of the maximum torque applied up to that point in the tightening cycle and for providing a fourth indicating signal indicative thereof, said checking means gate means being responsive to said first, second, third and fourth indicating signals.

89. A control system in accordance with claim 88 wherein said predetermined percentage is between about 25% to 75%.

90. A control system in accordance with claim 88 wherein said predetermined percentage is about $66\frac{2}{3}$%.

91. A control system in accordance with claim 86 wherein said checking means second means determines that the fastener assembly has been tightened into the tightening region of the torque-rotation curve that could be plotted for the fastener assembly being tightened.

92. A control system in accordance with claim 86 including torque measuring means for measuring the reaction torque on said wrench means and for providing a signal representative thereof, angle measuring means for measuring rotational displacement of the fastener assembly and providing a signal representative thereof, said checking means first means providing said second indicating signal each time the fastener has been rotated through said predetermined increment of rotation.

93. A control system in accordance with claim 92 wherein said checking means first means includes oscillator means operative to provide a series of output pulses each time a predetermined increment of rotation signal is provided.

94. A control system in accordance with claim 93 wherein said checking means first means includes storage means operative to receive rotational displacement signals each time said oscillator means provides a pulse and to provide an output signal representative of said stored rotational displacement signals, means for subtracting said storage means output signal from said rotational displacement signal and outputting a signal representative of the difference therebetween and comparator means responsive to said difference signal for determining when said difference signal equals a signal representative of the predetermined increment of rotation and for providing a signal operating said oscillator means.

95. A control system in accordance with claim 94 including means holding said storage means inoperative when said torque signal is less than a predetermined torque signal.

96. A control system in accordance with claim 94 wherein said control means further includes storage means operative to receive torque signals each time said oscillator means provides a pulse and to provide an output signal representative of said stored torque signals and means for subtracting said output signal from said torque signal and outputting a signal representative of the therebetween.

97. A control system in accordance with claim 96 wherein time delay means is operatively associated with said oscillator means so that additional pulses are provided by said oscillator means after a predetermined increment of rotation signal is provided.

98. A control system in accordance with claim 96 wherein said control means further includes additional storage means operative to receive said difference signal each time said oscillator means provides a pulse if said difference signal is larger than the previously stored signal and to provide an output signal representative of said stored difference signals, and means for determining when said difference signal is a predetermined percentage of said stored difference signals.

99. A control system in accordance with claim 93 wherein said checking means first means includes first storage means operative to receive rotational displacement signals each time said oscillator means provides a pulse and to provide a first output signal representative of said stored rotational displacement signals, means for subtracting said first output signal from said rotational displacement signal and outputting a first signal representative of the difference therebetween and first comparator means responsive to said first difference signal for determining when said first difference signal equals a signal representative of the predetermined increment of rotation and for providing a signal operating said oscillator means, said control means further including second storage means operative to receive torque signals each time said oscillator means provides a pulse and to provide a second output signal representative of said stored torque signals, second means for subtracting said second output signal from said torque signal and outputting a second signal representative of the difference therebetween, third storage means operative to receive second difference signals each time said oscillator means provides a pulse if said second difference signal is larger than the signal previously stored in said third storage means and to provide a third output signal representative of said stored second difference signals, and means for determining when said third output signal is a predetermined percentage of said second output signal.

* * * * *